US006647856B1

(12) United States Patent
Neal

(10) Patent No.: US 6,647,856 B1
(45) Date of Patent: Nov. 18, 2003

(54) TURBINE COMPRESSOR ARMOR SHIELD

(76) Inventor: Murray L. Neal, 681 E. Brighton La., Fresno, CA (US) 93720

( * ) Notice: Subject to any disclaimer, the term of this patent is extended or adjusted under 35 U.S.C. 154(b) by 0 days.

(21) Appl. No.: 09/881,319

(22) Filed: Jun. 13, 2001

(51) Int. Cl.[7] ..... F41H 5/04
(52) U.S. Cl. ..... 89/36.02; 2/2.5
(58) Field of Search ..... 89/36.02; 2/2.5

(56) References Cited

U.S. PATENT DOCUMENTS 5,724,670 A * 3/1998 Price ..... 2/2.5
5,796,028 A * 8/1998 Field et al. ..... 89/36.02
5,926,842 A * 7/1999 Price et al. ..... 2/2.5

OTHER PUBLICATIONS

Commerce Daily, USA Armoring, LLC. Awarded Sole Source Emergency Status Contract For: APU Armor Assemblies Applicable to the CH–47D Aircraft System, Website, Nov. 5, 1999, 7 pages, PSA#2470, Redstone Arsenal, AL.

* cited by examiner

*Primary Examiner*—Stephen M. Johnson
(74) *Attorney, Agent, or Firm*—Blakely, Sokoloff, Taylor & Zafman LLP

(57) ABSTRACT

A method and apparatus comprising combining fragment resistant fabrics in multiple layers in a resin, wherein the multiple layers present a fragment projectile with alternating tougher and softer resistances to penetration to enhance the stopping power of the composite armor while retaining a lightweight configuration is disclosed.

20 Claims, 2 Drawing Sheets

TURBINE COMPRESSOR ARMOR SHIELD

BACKGROUND

1. Field of the Invention

The invention relates to armor. More specifically, the invention relates to fiber reinforced composite armor.

2. Background

In recent years, fragment-resistant materials formed from high tensile strength fibers such as aramid fabrics or polyethylene fabrics have gone into common use. These fragment resistant materials typically have the advantages of greater tensile strength and the less weight per unit area then metals.

High-tensile strength fibers such as, for example, aramid fibers in fabrics have been combined with polymer matrices to form polymer-polymer composite armor. These fiber reinforced polymer matrices benefit from the high-tensile strength of the aramid fabric and high resistance to fracture and fatigue of the polymer matrix. Multiple layers of high tensile strength aramid fabric can be combined with epoxy matrices, and compacted into an armor shield or housing.

High performance engines, for example, in airplanes or helicopters, frequently have high performance turbines that spin at very high velocities. The tremendous energy imparted to these turbines can suddenly be released by a catastrophic event. A catastrophic event may occur when, for example, a turbine fails and breaks apart due to fatigue. A fragment of the failed turbine, released from its anchor on the turbine shaft, will have its angular momentum converted into velocity and hit the turbine housing with tremendous force.

A turbine housing designed to withstand such a failure and resist penetration of the fractured turbine part before it causes injury will need to have high fragmentation projectile resistance. A turbine housing designed to withstand such a failure in a helicopter engine will require high fragmentation projectile resistance and lightweight. A turbine housing designed to withstand such a failure in an armor vehicle or boat engine where adequate air circulation is not available will require high fragmentation projectile resistance and an ability to operate at high temperatures.

A simulation for a fragmentation test based more directly on the particular threat involved is the "simulated fragmentation test." A projectile is made out of, for example, a tri-lobed compressor wheel, which is fashioned, from high-hardened steel or a titanium composite. The tri-lobed compressor wheel is cut into pieces, each of which is turned into a projectile. The projectile is loaded into a sabot round and fired out of the 76 mm smooth bore cannon. This simulated fragmentation test is a more specific threat simulation and applies more closely to armor designed for a turbine housing. Existing turbine housings are capable of withstanding up to about 10,000 foot pounds of force as measured by the above mentioned "simulated fragmentation test" before failing.

DETAILED DESCRIPTION

Figure 1:
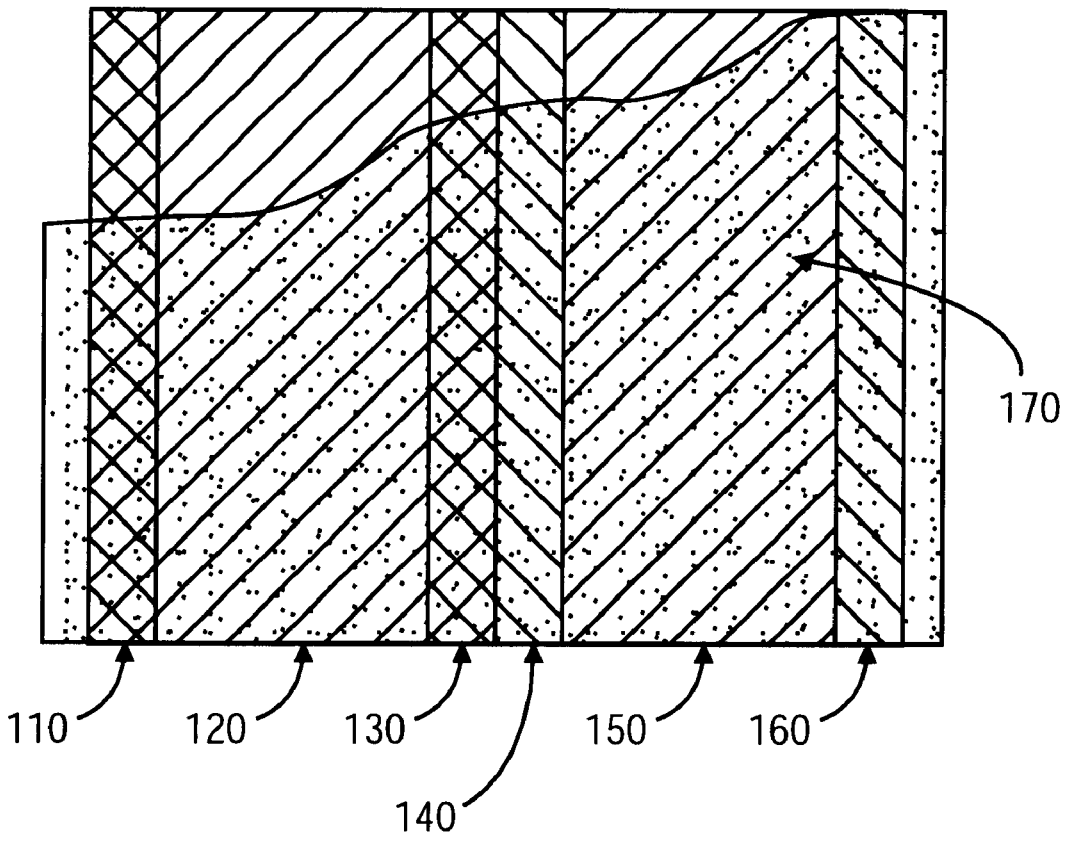
FIG. 1 is a cutaway view of the one embodiment of the composite armor.

In the following description, for purposes of explanation, numerous specific details are set forth to provide a thorough understanding of the invention. It will be apparent, however, to one of ordinary skill in the art, that the invention may be practiced without some of the specific details mentioned in the description. The following description and accompanying drawings provide examples for the purpose of illustration. However, these examples should not be construed in a limiting sense, as they are merely intended to provide examples of the invention, rather than to provide an exhaustive list of all possible implementations of the invention.

As used herein, a composite armor is defined as an armor made up of at least two distinct phases of material that, when combined together, reinforce each other with their respective best physical properties, allowing the composite article to have better physical properties than either single phase has alone. In one embodiment, the composite article is a polymer-polymer composite. Polymer fibers are used to reinforce a polymer resin or matrix.

Polymer matrices have high resistance to creep, and crack propagation. Polymer fibers have high tensile strength. A composite armor made of polymer matrix, and polymer fabric reinforcement gains from the benefits of each material and the combination has high resistance to fracture and failure. Fabric reinforcement contributes high tensile strength and resistance to yielding in the presence of a projectile impact. The polymer matrix contributes a greater toughness and resistance to fatigue and creep, heat and chemical resistance.

In this composite armor, the polymer matrix, or resin, does three things. The resin supports fibers in place, thus transferring stress from one layer of the fibers to the next layer, both within the ply and between the plies of fabric. The resin also protects fibers against physical damage from the environment, chemical exposure and chaffing. And finally, the resin reduces the likelihood of crack propagation through the composite by offering greater toughness.

Conventional composite armor attempts to enhance the density of the medium in order to be better able to resist the full impact of a projectile's energy. Typically, composite armor uses the highest tensile strength fiber reinforcement available along with a high resistance to fracture polymer matrix. Traditionally, the highest tensile strength aramid fabrics have had pick counts and threads that offered the greatest denier. These high denier, fabrics have been the fabric of choice for composite armor material.

Some high-tensile strength fragment resistant materials tend to deform and slow down a projectile, while other types of high tensile strength ballistic materials, tend to grab and turn a fragment projectile. Typically higher tensile strength materials having lower relative elongation of yield grab at the projectile and tug it toward a side, rather than deforming it as the projectile penetrates the material.

The behavior of high tensile strength ballistic material is a function of the materials tensile strength, elongation of yield, and pick count. The tensile strength of the fibers in a ballistic fabric is a leading indicator of that fabric's ability to induce yaw into the path of a projectile. A higher tensile strength gives the fabric a better ability to grab the projectile before yielding to penetration by the projectile than a ballistic fabric with a lower tensile strength. The fabric's grabbing at the projectile before yielding is what induces yaw into the path of the projectile. Yaw is a pivoting motion perpendicular to the direction in which the projectile is traveling.

A fragment undergoing yaw will either roll onto its side or tumble. If the fragment projectile rolls or tumbles, more surface area is exposed to be caught by the armor. The armor typically will have better stopping ability against a projectile with a large area of surface in contact with it, than with a small area of service in contact with it.

The tensile strength of a ballistic fabric can be increased by increasing the denier of the thread of material used to weave the fabric. Thus, for example, a ballistic fabric with a thread having a denier greater than 2000 will have a higher tensile strength than a ballistic fabric made from an identical chemical with a thread having a denier of less than 1000.

The elongation of yield of a ballistic fabric is a leading indicator of that fabric's ability to induce deformation into a projectile. When struck by a fragment projectile, a high tensile strength ballistic material with a high pick count and a low elongation to failure will tend to grab at the projectile and turn it to induce yaw, but will not cause much deformation of the projectile. A ballistic material with a higher elongation to failure will tend to hang on to the projectile as the fibers of the material stretch. The stretching of the material allows additional time for the fabric to hang on to the projectile deforming the projectile and slowing it down as fibers elongate, before yielding to penetration.

Strong but brittle fabrics such as, for example, electronic grade fiberglass, which is a calcium aluminoborosilicate glass, work by delaminating upon impact by the projectile. Fiberglass delaminates more easily than does the aramid fabric. While delaminating, the fiberglass fabric grabs around the sides of the projectile engaging more surface area of the projectile. Electronic (or e) grade fiberglass has an ultimate tensile strength of about 508,000 pounds (force) per square inch. This tensile strength allows the e grade fiberglass to blunt any sharp edges the fragment may have on its striking surface as it absorbs energy from the impact and slows the velocity of the projectile.

The resin used to form the composite needs to perform several functions. The resin must bond to the fiber reinforcement, and have a high resistance to creep, fatigue and crack propagation. The resin must also be able to operate in high temperature environments for long durations. A phenolic resin, suitable for use under these conditions is commercially available from Lewcott Corp. of Millbury Mass.

It has been found that by confronting a high-velocity projectile with an alternating series of tougher and softer layers, the tougher layers inducing yaw and the softer layers inducing deformation and slowing down the high-velocity projectile, greater stopping power is achieved over a similar number of layers of either individual material type.

One embodiment of the current claim confronts a high velocity fragment projectile with several different layers that have different reactions to impact. These different layers present a projectile with an alternating high-tensile strength, high resistance to penetration layer with lower tensile strength lower levels of resistance to penetration layers. The fibers in a lower tensile strength, lower resistance to penetration layer have a higher elongation of yield compared to the fibers in a high tensile strength layer. Greater elongation of yield allows the lower tensile strength layers to deform the projectile as it passes through the armor layer.

It should be noted that similar fabric materials with different deniers and pick counts effectively make different material. This is because they will have different mechanical properties. Higher denier means there is more of the fiber per length of thread. This additional material gives the thread greater tensile strength. Greater tensile strength gives the fabric greater resistance to penetration. Higher pick counts mean there are more threads per area to be struck by the projectile. These additional threads in higher pick count materials add their tensile strength to the resistance to penetration of the fabric.

While materials with similar deniers and pick counts might be thought to have similar stopping power and ballistic abilities, a varying elongation to failure can make these materials respond to ballistic events differently. Thus it is not always possible to base exact ratios of projectile stopping ability based on only denier and pick counts.

One embodiment of the invention uses various lay ups of Kevlar™ 29 3000 denier fabrics, Kevlar™ 129 840 denier fabrics and electronic grade fiberglass fabrics. One of ordinary skill in the art would recognize however that with adequate notice given to denier, pick count and elongation to failure, various materials might be substituted for the materials mentioned above. Such substitutions can be, but are not limited to, para aramids such as PBO, Zylon™, various denier Kevlar™ KM2 materials such as 800, 600, or 400 denier material, and Kevlar™ 129 400 denier material. Also, substitutions for the e grade fiberglass may be, but are not limited to, s grade fiberglass.

Reference will now be made to drawings. In the following drawings, like structures are provided with like reference designation. In order to show the structures of the invention more clearly, the drawings included herein are diagrammatic representations of the indicated structures. Thus, the actual appearance of the fabricated structures, for example in a photograph, may appear different while still incorporating the central structures of the invention. Moreover, the drawings show only the structures necessary to understand the invention. Additional structures known in the art have not been included to maintain the clarity of the drawings.

Composite armor can be made by combining various layers of aramid fabrics, polyethylene fabrics, and fiberglass fabrics and setting up these layers in a resin. Setting up the layers in a resin as used herein means the resin permeates the layers of fabric. Permeation of the layers of fabric means that the resin is on and between the threads of a given fabric, and on and between the different plies and layers of fabric.

FIG. 1 is a side cut-away cross-sectional view of composite armor of one embodiment of the invention. The composite armor is a combination of layers designed to alternately cause deformation to a fragment and to induce yaw to the path of the projectile. The first layer of the composite armor 110 as shown in FIG. 1 is a high tensile strength brittle ballistic fiber fabric. In one embodiment, the first layer is five plys of electronic grade fiberglass (e-glass) fabric with a pick count of about 54×54 to about 58×58. Five plys of e-glass with this pick count has an areal density of approximately 13.44 oz. per sq. ft.

In FIG. 1, the second layer 120 is a high tensile strength low pick count low denier ballistic aramid fabric that tends to deform fragments better than high denier high pick count ballistic fabrics. These low denier, low pick count fabrics have the added benefit of lighter weight compared to high denier, high pick count fabrics. High tensile strength aramid fabric is now available with a denier of about 850. Similar fabric with a denier of about 600 is now becoming available. In the near future deniers of about 500 and 400 will be available. These lower denier fabrics will be even lighter than the approximately 850-denier fabrics are. It is anticipated that these even lower denier fabrics will have even greater deformation ability than the currently available approximately 850-denier fabric has.

In one embodiment, the second layer 120 can be 21 plys of Kevla™ 129 840 denier with a pick count of about 25×25 to 28×28 and an aggregate areal density of about 15.16 oz. per sq. ft. This layer will tend to induce deformation into a projectile contacting it. The higher elongation of yield of the fibers in the fabric will allow the fabric to hold onto the projectile longer as it stretches before yielding. This longer hold time will deform the projectile more than a fabric with a lower elongation to yield.

The third layer in FIG. 1, 130 in one embodiment, can be three plys of the e-glass fabric of the first layer 110. This layer would be hard and brittle, and tend to blunt any sharp edges the fragment may have on its striking surface. This layer would have an areal density of about 8.04 oz. per sq. ft.

The fabric in the first and third layers 110 and 130 of one embodiment may have a variety of weaves. If the composite armor is to be a flat sheet, a plain weave of the fabric may be appropriate. A plain weave is where the fibers of the fabric are woven over one under one over one etc. in both directions. If however, a shape or some curve is desired in the composite armor, alternate weaves are better to accommodate the change in shape of the armor. For example, an eight-harness satin weave will make the fabric a little more pliable and better enable it to conform to a shape with a curve. An eight-harness satin weave is where the fibers are threaded over seven under one in both directions.

A fourth layer 140, in one embodiment, is five plys of Kevlar™ 29 3000 denier aramid fabric with a pick count of about 23×23 to about 26×26. This layer tends to induce yaw into a fragment contacting it, because of the high tensile strength and low elongation to failure of the thread of this fabric.

In one embodiment, a fifth layer 150 can be 21 plys of Kevlar™ 129 840 denier with a pick count of about 25×25 to 28×28 and an areal density of about 15.16 oz. per sq. ft. This layer will tend to induce deformation into a projectile contacting it. A higher elongation of yield of the threads in this fabric will allow the fabric to hold onto the projectile longer as it stretches before yielding. This longer hold time allows the fabrics to deform the projectile more than a fabric with a lower elongation to yield can.

In one embodiment, a sixth layer 160 may be four plys of Kevlar™ 29 3000 denier aramid fabric with a pick count of about 23×23 to 26×26. The areal density of this layer is about 6.4 oz. per sq. ft. This layer would tend to resist penetration and act as a final backstop to the composite armor trapping a projectile within the armor.

Suffused throughout the various layers of fabric in FIG. 1 is a resin 170. The resin transfers force from one layer to another when an individual ply fails. In one embodiment the resin is a phenolic resin commercially available from Lewcott Corp. of Millbury, Mass. The phenolic resin has a flexural strength of about 79,000 pounds per square inch (PSI), a flexural modulus of about 4,100,000 PSI, a tensile strength of about 55,600 PSI, a compressive strength of at least 62,700 PSI, and a Barcol hardness of 84. The resin binds all layers and plies of fabric together. One suitable resin permits continuous operation at 500° F.

In one embodiment the composite armor has a first layer having a plurality of plies of a first material encased front and back by a plurality of plies of a second material. A second layer having a plurality of plies of the first material encased front and back by a plurality of plies of a third material is coupled to the first layer. The armor is impregnated with a resin, and weighs less than 4.5 pounds per square foot of protected area. Additionally in one embodiment, the armor can operate continuously at 500° F. and can stop an object weighing 1.1 pounds travelling lease 760 feet per second generating at least 15,000 foot pounds of force. In one embodiment, fewer than twenty-five plies of the first material are used with each ply having a denier Less than 1000 and a pick count less than 40×40. In one embodiment, the second material has a tensile strength of about 3500 MPa and a pick count of less than 60×60. In another embodiment, the third material has a denier greater than 2000 and a pick count less than 40×40. In one embodiment, each layer of second material has fewer than scan plies and each layer of the first material has fewer than twenty-five plies. In one embodiment, the armor has fewer than sixty-five total plies.

Figure 2:
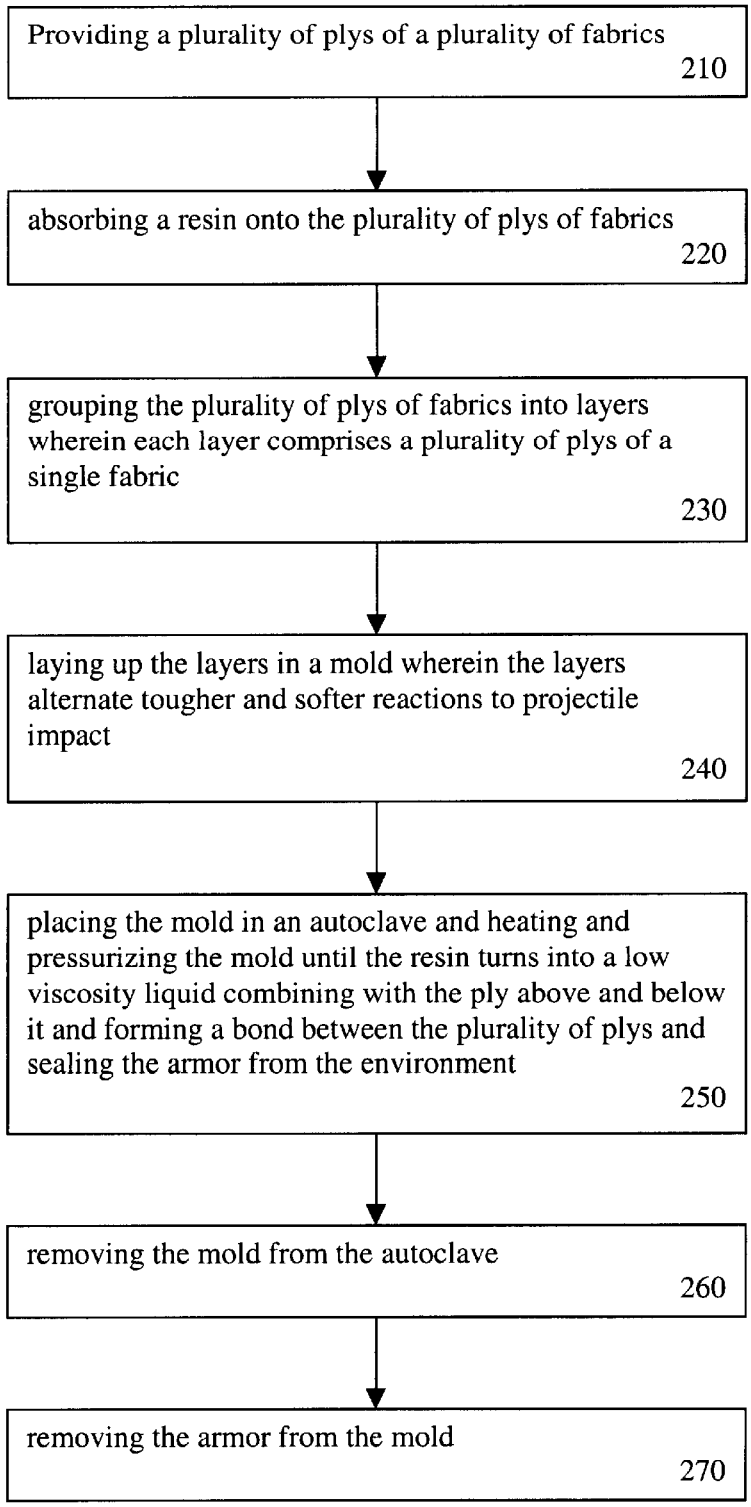
FIG. 2 is a flow chart showing one method of fabricating the composite armor.

FIG. 2 is a flow diagram representing one method of fabricating the composite armor of FIG. 1. The plurality of layers of plies of ballistic grade fabric may be laid up in a mold and introduced into an autoclave. This mold can take the form of flat sheets or have various edges and surfaces to shape the layers of fabric by the mold.

In one embodiment, multiple plies of differing fabrics at Block 210 are assembled. These many layers of fabrics have a resin absorbed into them at Block 220. In one embodiment, the resin is adhered to the fabric by having a layer of sticky tape coated with the resin placed next to the fabric and the sticky tape and the layer of fabric are run through a hot roller press. The sticky tape is made of a resin and a backing material. When the fabric is ready for use, the backing material is removed, leaving the resin absorbed in the fabric. The fabric is then placed into layers.

The plies of fabric are then sorted into layers wherein each layer comprises several plies of a single fabric, as at block 230. The fabrics are then grouped into multiple layers of fabric, wherein each layer of fabric comprises only one type of fabric. Once grouped into layers of single fabrics, the layers of fabrics can be laid up in various positions relative to one another in a mold as in Block 240. In one embodiment, the lay-up of the layers of fabric can present to an anticipated projectile alternating tougher and softer reactions to projectile impact.

The mold is placed in an autoclave, heated and pressurized until the resin turns to a low viscosity liquid at Block 250. In one embodiment, the autoclave reaches a temperature of about 325° F. and a pressure of about 50–300 psi. This low viscosity liquid combines with the ply above and below it, forming a complete bond between the many plies and sealing the fabric from the environment. Bonding with the above and below layers of fabric is important in that it enables the composite armor to transfer energy of impact between fibers within a single fabric layer, but when an individual fiber layer's ability to absorb energy is exceeded, the resin can then transfer energy between layers of fabric. Once the resin is held at temperature for sufficient time, it "gels" and becomes a hard catalyzed finished product. When the resin has had sufficient time to combine with the plies of the composite armor the mold is removed from the autoclave, at Block 260. The single-piece solid armor is then removed from the mold, at Block 270.

In another embodiment, the resin can be absorbed in to the layers of fabric by a Vacuum Assisted Resin Transfer Method (VARTM). All of the ply counts are laid up in a desired configuration. The plys are then placed into a vacuum controlled bay that is put into an autoclave rather then running through sticky tape and then a press. As the resin is injected into the material, the vacuum pulls on it, helping pull the resin through the material from one end to the other, then run through the autoclave sequence. The appropriateness of the VARTM process depends on type and viscosity of resin to be used.

Trapped pockets or voids can form sometimes when the resin does not get to all areas of the fabric. Temperature is an important issue when trying to pull resin through especially with various densities of materials. The temperature should be sufficient to cause the resin to flow in conjunction with the vacuum, but not so high as to cause the resin to "gel" too early.

In another embodiment, the resin can be absorbed into the layers of fabric by a Co-Injection Resin Transfer Molding (CIRTM) method, which may use more than one type of resin. Phenolics and vinyl esters can be mixed to make different resins with better mechanical properties than either individual resin has. There are high fixed costs, associated with CIRTM, however, if enough material is required, the unit cost can be competitive with other resin transfer methods.

With CIRTM, the weight of the composite could be reduced still further. Weight can be reduced by using lighter weight resins on interior layers that don't come in contact with the outside environment and therefore do not require water resistance. The composite can drop weight by using vinyl ester or other type of adhesive on the first layer and using a phenolic resin later and as an overall coating cap for overall heat and chemical resistance. This combination could have a lighter weight because the density of the mixture of resin would not have been as high as using only the phenolic resin.

CIRTM injects resins side-by-side so they don't mix. A cross section of the composite armor would have the different resins staying within their intended layers of fabric.

The two categories of resins used in forming composite armor are thermosets and thermoplastics. Thermosets will change chemical composition when heated so there is only one chance to form the shape of the object. Thermoplastics do not undergo chemical changes when heating up, so may be cycled many times. Thermoplastics are good for moisture barriers because they are non-hydroscopic, but they can be affected by solvents. Thermoset resins tend to provide good resistance to chemical attack, but do not make good moisture barriers. In one embodiment, the thermoset resin is used because there is little moisture when there is a substantial amount of heat, but the armor had to be resistant to hydraulic fluid and jet fuel.

Trade-offs in composite armor requirements can dictate the use of one resin transfer method over another. Co-injection (CIRTM) can use multiple types of resins, while vacuum assisted is generally a single resin system, and sticky tape is a single resin transfer system. VARTM allows laying up a group of layers at a time but only one type of resin at a time. CIRTM allows using multiple types of resin put into each of the plys at once. However, CIRTM is five times more expensive than VARTM.

As described above, one measure of the stopping ability of a composite armor is the "simulated fragmentation test." The composite armor of one embodiment as described above is capable of withstanding at least 15,000 foot pounds of force as delivered by the simulated fragmentation test. As described above, the simulated fragmentation test is a specific threat simulation, which applies closely to armor designed for a turbine housing.

In the preceding detailed description, the invention is described with reference to specific embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

What is claimed is:

1. A composite armor comprising:

a first layer having a plurality of plies of a first material encased front and back by a plurality of plies of a second material a second layer having a plurality of plies of the first material encased front and back by a plurality of plies of a third material, the armor impregnated with a resin, wherein the armor weighs less than 4.5 pounds per square foot of protected area, can operate continuously at 500° F., and can stop an object weighing 1.1 pounds travelling at least 760 feet per second generating at least 15,000 foot pounds of force.

2. The composite armor of claim 1, wherein the resin comprises a phenolic resin impregnated throughout the armor material.

3. The composite armor of claim 1, wherein the resin has a flexural strength of at least 79,000 psi, a flexural modulus of at least 4,100,000 psi, a tensile strength of at least 55,600 psi, a compressive strength of at least 62,700 psi and a Barcol hardness of at least 84.

4. The first layer of claim 1, wherein the first material acts to slow and deform a projectile and the second material acts to slow and grab the projectile.

5. The layer of claim 4, wherein the first material comprises less than 25 plies of an aramid fabric having a denier of less than 1000 and a pick count of less than 40×40, and the second material comprises less than seven plies of fiberglass having an ultimate tensile strength of about 3500 MPa and a pick count of less than 60×60.

6. The second layer of claim 1, wherein the first material acts to slow and deform a projectile and the third material acts to induce yaw into a projectile.

7. The layer of claim 6, wherein the first material comprises less than twenty-five plies of an aramid fabric having a denier of less than 1000 and a pick count of less than 40×40, and the third material comprises less than seven plies of an aramid fabric having a denier of greater than 2000 and a pick count of less than 40×40.

8. The composite armor of claim 1, wherein arranging the plies of the armor to alternately present the projectile with tougher and softer barriers to penetration allows the achievement of greater stopping power using fewer total plies than the number of plies required of any one type of material.

9. The composite armor of claim 1, comprising fewer than sixty-five total plies.

10. A composite armor comprising:

a first layer of fabric, a second layer of fabric coupled to the first layer being different than the first layer, a third layer of fabric coupled to the second layer being different than the second layer, a fourth layer of fabric coupled to the third layer being different than the third layer, a fifth layer of fabric coupled to the fourth layer being different than the fourth layer, a sixth layer of fabric coupled to the fifth layer being different than the fifth layer, wherein the adjacent layers of differing fabric have greater stopping power for being adjacent as described than a similar number of plies of either material, the armor weights less than 4.5 pounds per square foot, can operate continuously at 500° F., and can stop an object weighing 1.1 pounds travelling at least 760 feet per second generating at least 15,000 foot pounds of force.

11. The composite armor of claim 10, wherein;

a first fabric is used for the first and third layers, a second fabric is used for second and fifth layers, and a third fabric is used for the fourth and sixth layers.

12. The composite armor of claim 10, wherein;

the first fabric comprises fiberglass having a ultimate tensile strength of about 3500 MPa, and a pick count of less than approximately 60×60.

13. The composite armor of claim 10, wherein;

the first fabric tends to slow down a projectile impacting it.

14. The composite armor of claim 10, wherein;

the first fabric tends to delaminate and grab onto the sides of a penetrating projectile impacting it.

15. The composite armor of claim 10, wherein the second fabric has a denier of less than approximately 850, and a pick count of less than approximately 40×40.

16. The composite armor of claim 10, wherein the second fabric tends to induce deformation into a projectile impacting it.

17. The composite armor of claim 10, wherein the third fabric has a denier of greater than approximately 2000, and a pick count of less than approximately 40×40.

18. The composite armor of claim 10, wherein the third fabric tends to induce yaw into a projectile impacting it.

19. The composite armor of claim 10, wherein the first and third layers each have a ply count less than seven, the second and fifth layers each have a ply count of less than twenty-five, and the fourth and sixth layers each have a ply count less than seven.

20. The composite armor of claim 10, wherein the total ply count of all the layers is less than sixty-five.

* * * * *